US005390504A

United States Patent [19]

Hida et al.

[11] Patent Number: 5,390,504

[45] Date of Patent: Feb. 21, 1995

[54] PROTECTIVE DEVICE FOR AUGER TYPE ICE MAKING MACHINE

[75] Inventors: Junichi Hida, Peachtree City, Ga.; Kazuhiro Mori, Toyoake; Susumu Tatematsu, Nagoya, both of Japan

[73] Assignee: Hoshizaki Denki Kabushiki Kaisha, Toyoake, Japan

[21] Appl. No.: 128,301

[22] Filed: Sep. 29, 1993

[30] Foreign Application Priority Data

Jan. 10, 1992 [JP] Japan ..... 4-068734[U]

[51] Int. Cl.[6] ..... F25C 5/18

[52] U.S. Cl. ..... 62/137; 200/612

[58] Field of Search ..... 62/137, 354; 200/61.2, 200/61.21, 61.42, 330, DIG. 15

[56] References Cited

U.S. PATENT DOCUMENTS

| | | | |
|---|---|---|---|
| 1,951,980 | 3/1934 | Jacobson | 200/DIG. 15 |
| 2,429,158 | 10/1947 | Francis | 200/61.21 |
| 2,615,102 | 10/1952 | McMath | 200/61.21 |
| 3,396,694 | 8/1968 | Gruber | 200/61.21 X |
| 4,044,209 | 8/1977 | Peterson | 200/61.21 |
| 4,993,232 | 2/1991 | Tatematsu et al. | 62/137 |
| 5,142,878 | 9/1992 | Hida et al. | 62/137 |

FOREIGN PATENT DOCUMENTS 3-25109 5/1991 Japan .

*Primary Examiner*—William E. Tapolcai
*Attorney, Agent, or Firm*—Nikaido, Marmelstein, Murray & Oram

[57] ABSTRACT

A protective device for an auger type ice making machine having an auger type ice making mechanism the refrigeration housing of which is located adjacent an ice storage bin and provided thereon with an ice discharge casing forming a lateral discharge passage for discharging ice pieces into the storage bin through an upright delivery chute. The protective device is in the form of a spout switch assembly which is mounted on an upper wall of the ice discharge casing at a position laterally displaced from an upper end of the refrigeration housing to detect ice pieces filled in the ice discharge casing during operation of the ice making mechanism.

4 Claims, 4 Drawing Sheets

PROTECTIVE DEVICE FOR AUGER TYPE ICE MAKING MACHINE

BACKGROUND OF THE INVENTION

1. Field of the Invention

The present invention relates to an auger type ice making machine, and more particularly to a protective device for the ice making machine for preventing the ice discharge passage of the ice making machine from being blocked with ice pieces supplied therein.

2. Description of the Prior Art

In a conventional auger type ice making machine the refrigeration housing of which is located adjacent an ice storage bin and provided thereon with an ice discharge casing forming a lateral discharge passage for discharging ice pieces into the ice storage bin therefrom through an upright delivery chute, an ice detection device is provided within the delivery chute at a position adjacent an outlet of the lateral discharge passage. In operation of the ice making machine, ice pieces are supplied into the lateral discharge passage from the refrigeration housing and fall into the ice storage bin through the delivery chute. When the delivery chute is filled with the ice pieces due to increase of the amount of ice pieces stored in the storage bin, a movable detection plate of the ice detection device is moved by the ice pieces to deactivate the ice making mechanism. If the ice detection device was not operated due to unexpected trouble, the lateral discharge passage of the casing would be blocked with ice pieces continuously supplied from the ice making mechanism. This results in an increase of the internal pressure of the ice discharge casing and an increase of load acting on a geared-motor of the ice making mechanism. If the geared-motor is locked by increase of the load acting thereon, a protective device for prevention of excessive current is operated to deactivate the ice making machine. In the ice making machine, it is, however, afraid that the internal pressure of the ice discharge passage excessively increases before the geared-motor is deactivated by operation of the protective device, resulting in damage of the ice discharge casing.

In an auger type ice making machine disclosed in Japanese Patent Laid-open Publication No. 3-25190, an ice guide member is mounted on an extended portion of a refrigeration housing and loaded by a spring downwardly to introduce ice pieces into a lateral discharge passage. When the ice guide member is raised by increase of the internal pressure in the lateral discharge passage, a microswitch is operated by upward movement of the guide member to deactivate the ice making machine. In this ice making machine, the ice guide member is raised by ice pieces supplied at a time into the discharge passage if the ice making performance excessively increases due to fall of the ambient temperature or the water temperature or if ice pieces are packed in the refrigeration housing. This results in unexpected stopping of the ice making machine.

SUMMARY OF THE INVENTION

It is, therefore, a primary object of the present invention to provide an improved protective device for the auger type ice making machine capable of overcoming the problems discussed above.

According to the present invention, the object is accomplished by providing a protective device for an auger type ice making machine having an auger type ice making mechanism the refrigeration housing of which is located adjacent an ice storage bin and provided thereon with an ice discharge casing forming a lateral discharge passage for discharging ice pieces into the storage bin through an upright delivery chute, which protective device comprises a spout switch assembly mounted on an upper wall of the ice discharge casing at a position laterally displaced from an upper end of the refrigeration housing to detect ice pieces filled in the ice discharge casing during operation of the ice making mechanism.

In a practical embodiment of the present invention, the upper wall of the ice discharge casing is formed with an opening at the position laterally displaced from the upper end of the refrigeration housing, and the spout switch assembly comprises an actuator plate coupled with the opening of the ice discharge casing to be movable in a vertical direction and exposed to the interior of the discharge casing, a cover plate detachably coupled over the opening of the discharge casing and fixed in place on the upper wall of the discharge casing, and a switch unit disposed between the actuator plate and the cover plate to be operated by upward movement of the actuator plate.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
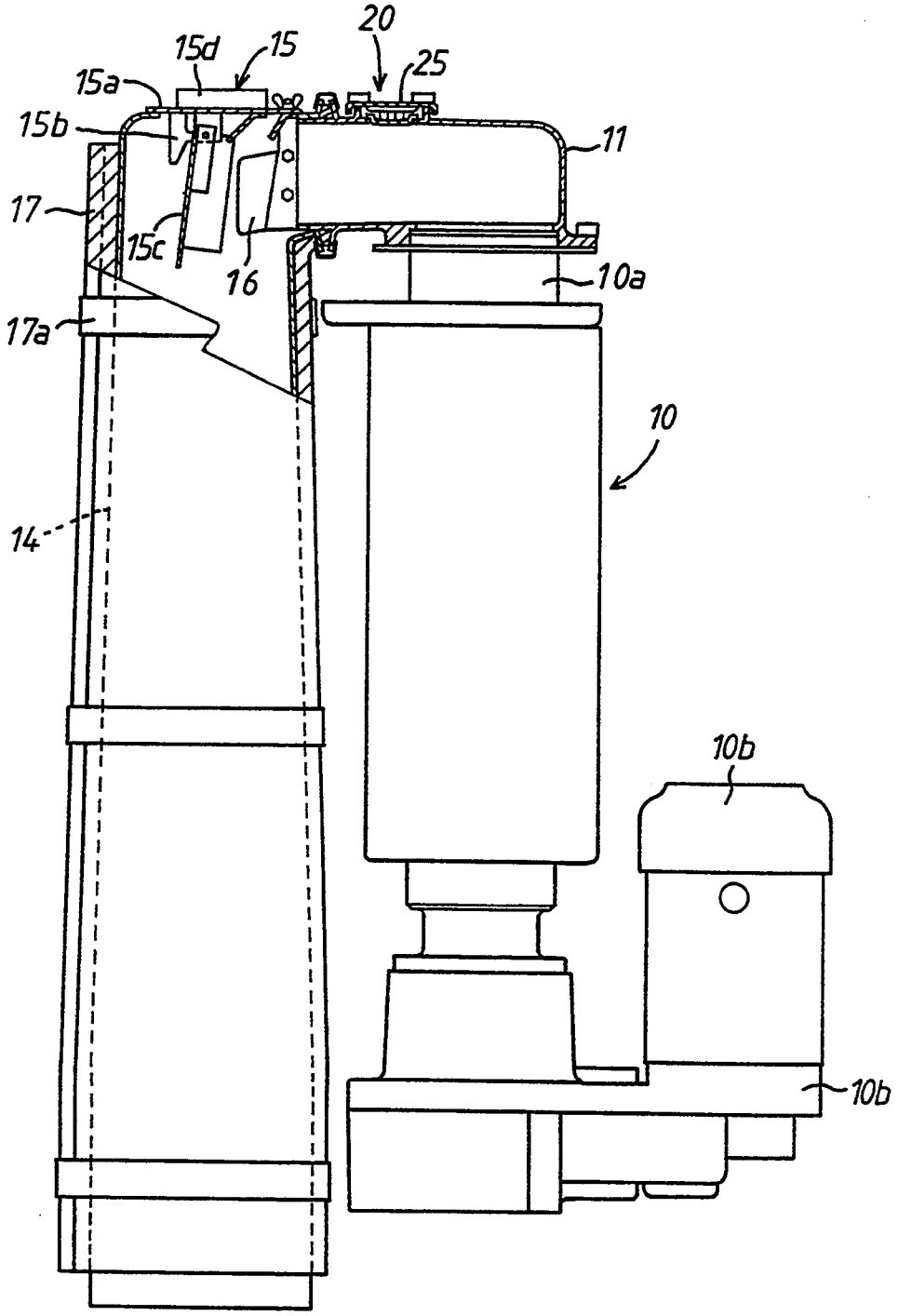
FIG. 1 is a partly broken side view of an auger type ice making machine provided with a protective device according to the present invention.

Referring now to the drawings, FIG. 1 illustrates an auger type ice making machine which includes an auger type ice making mechanism 10 located adjacent an ice storage bin (not shown), an ice discharge casing 11 mounted on an upper end of a cylindrical refrigeration housing 10*a* of the ice making mechanism 10 to form a lateral discharge passage, and an upright delivery chute 14 having an upper opening end connected to an opening end of the ice discharge casing 11 through a gasket. The upright delivery chute 14 is enclosed by a cylindrical heat-insulation cover 17 fixed thereto by means of fastening bands 17*a*. A spout switch assembly 20 is mounted on an upper wall of the ice discharge casing 11 at a position laterally displaced in an appropriate distance from the upper end of refrigeration housing 10*a*, and an ice detection device 15 is provided on an upper end portion of upright delivery chute 14.

An opening formed on the upper portion of delivery chute 14 is covered by a support plate 15*a* fixed thereto to support the ice detection device 15. A detection plate 15*c* is pivoted at its upper end to a bracket 15*b* fixed to a bottom surface of support plate 15*a* and is located to oppose the opening end of ice discharge casing 11. An ice detection switch 15*d* of the normally open type is mounted on the support plate 15*a* to be closed by swing movement of detection plate 15*c*. The detection plate 15*c* is bent at its both sides toward the ice discharge casing 11. A pair of baffle plates 16, 16 are fixed to the internal side walls of delivery chute 14 at the joint portion to the ice discharge casing 11 to prevent ice pieces directed toward the backside of detection plate 15*c* from the ice discharge casing 11.

Figure 2:
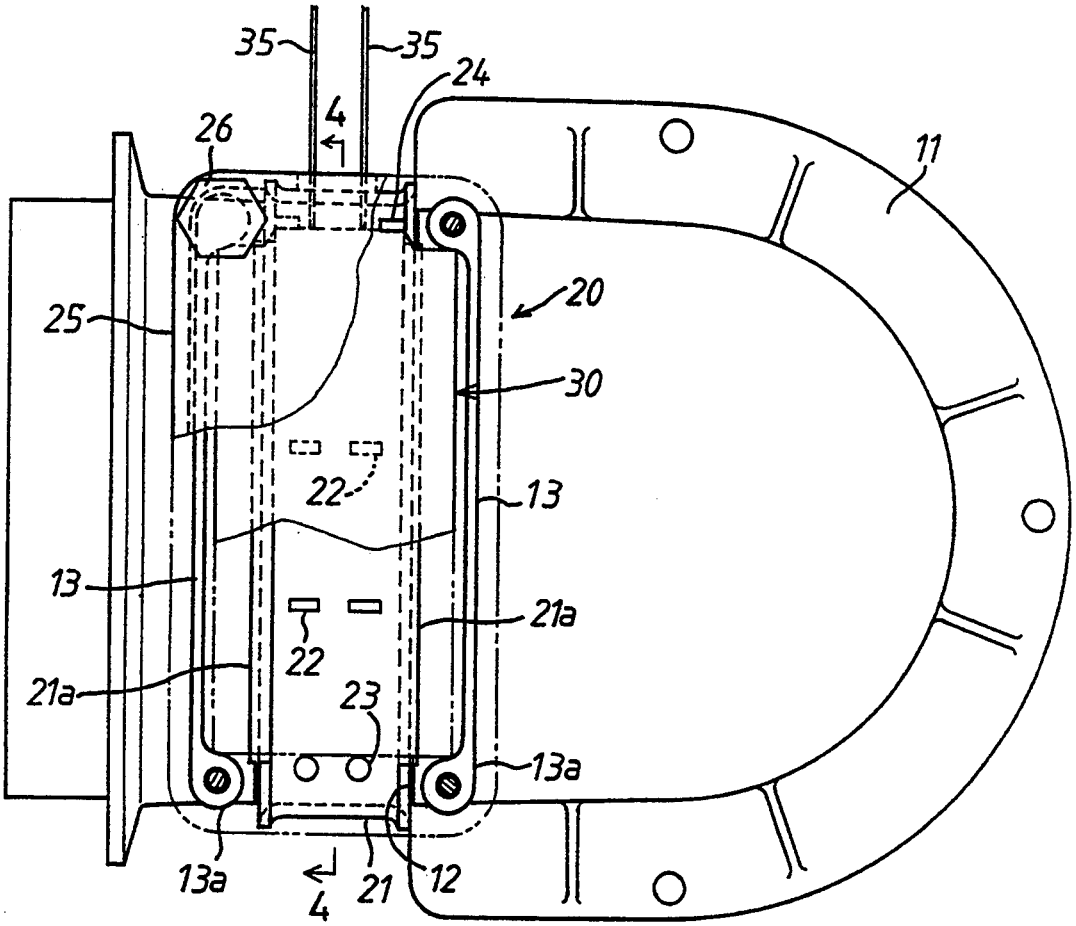
FIG. 2 is an enlarged plan view of an ice discharge casing provided thereon with a spout switch shown in FIG. 1.
Figure 3:
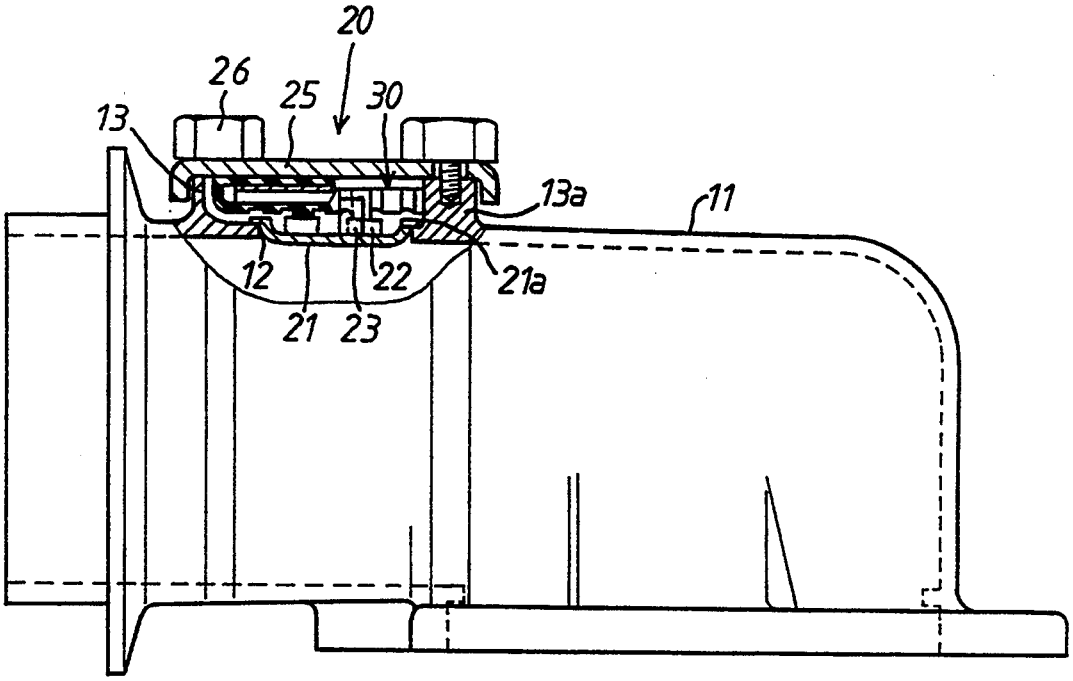
FIG. 3 is a partly broken side view of the ice discharge casing shown in FIG. 2.
Figure 4:
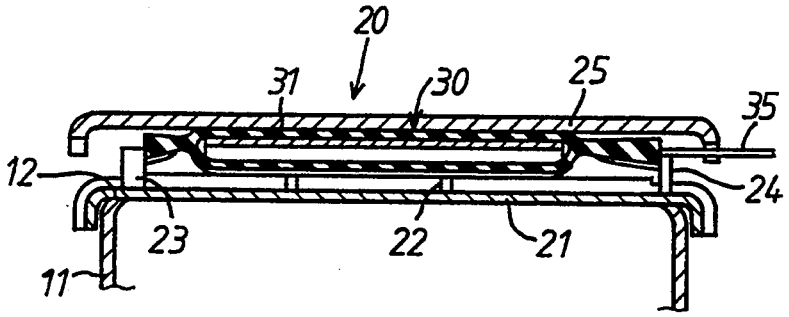
FIG. 4 is a sectional view taken along line 4—4 in FIG. 2.

As clearly shown in FIGS. 2 to 4. the upper wall of ice discharges casing 11 has a rectangular portion formed with a rectangular opening 12 which is located at the position laterally displaced from the upper end of refrigeration housing 10*a*. The spout switch assembly 20 includes a rectangular actuator plate 21 coupled with opening 12 of ice discharge casing 11 to be movable in a vertical direction. The actuator plate 21 is bent at its both sides downwardly as shown in FIG. 4 and is formed with a pair of lateral flanges 21*a* as shown in FIGS. 2 and 3. When the actuator plate 21 is engaged with rectangular opening edges of casing 11 at its lateral flanges 21*a*, the bottom surface of actuator plate 21 is slightly projected into the interior of casing 11. As shown in FIGS. 2 and 4, the actuator plate 21 is formed thereon with four projections 22 which are arranged to operate a switch unit 30. The actuator plate is further formed at its both sides with positioning projections 23 and 24 which are engaged with the switch unit 30. The positioning projections 23 and 24 are formed to be higher than the projections 22.

As shown in FIGS. 2 and 3, pair of ribs 13, 13 are integrally formed on the upper wall of casing 11 in parallel with the opposite ends of rectangular opening 12. The pair of parallel ribs 13, 13 are formed respectively at their both sides with a pair of bosses 13*a*, 13*a* each of which is formed with a screw thread. A rectangular cover plate 25 formed with a peripheral flange is coupled over the parallel ribs 13, 13 and is detachably fixed in place by means of fastening bolts 26 threaded into the bosses 13*a*. Disposed between the actuator plate 21 and cover plate 25 is the switch unit 30 to be operated by upward movement of the actuator plate 21.

Figure 5:
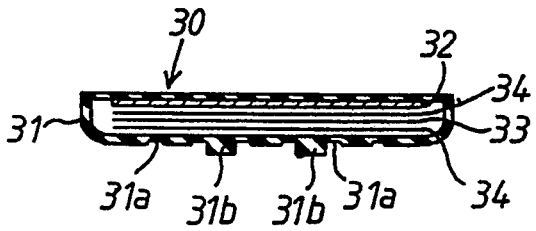
FIG. 5 is an enlarged cross-sectional view of a switch unit shown in FIG. 4.
Figure 6:
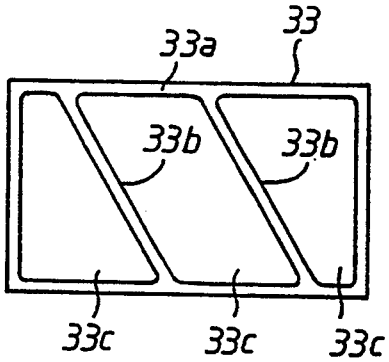
FIG. 6 is a plan view of a spacer plate shown in FIG. 5.
Figure 7:
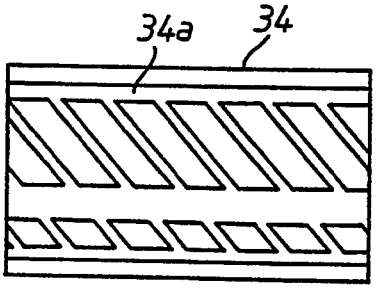
FIG. 7 is a plan view of a contact plate shown in FIG. 5.

As shown in FIGS. 4 to 7, the switch unit 30 includes an elastic tubular cover 31 formed to contain therein a rectangular rigid plate 32, a rectangular spacer plate 33 and a pair of rectangular contact plates 34 opposed to one another through the spacer plate 33. The elastic tubular cover 31 is made of a flat tube of elastic material formed by an extrusion process and cut in a predetermined length. As shown in FIG. 5, the bottom part of tubular cover 31 is formed with a plurality of spaced grooves 31*a* which extend in the whole length of tubular cover 31. Formed between the center grooves 31*a* are two ridges 31*b* higher than the other ridges. The spacer plate 33 is made of elastic insulation material such as polyethylene in thickness of about 0.3 mm. As shown in FIG. 6, the spacer plate 33 has a rectangular frame portion 33*a*, two parallel connecting portions 33*b* and three openings 33*c* formed within the frame portion 33*a*. The contact plates 34 each made of elastic insulation material as well as the spacer plate 33 and formed in the same configuration as the spacer plate 33 and in thickness of about 0.12 mm. The contact plates 34 each are coated with a conductive material 34*a* which is formed in three parallel bands and a number of parallel slant bands. The central wide band of conductive material 34*a* is connected to a lead wire 35. The rectangular rigid plate 32 is formed in the same configuration as the spacer plate 33 and in thickness of about 1 mm.

During an assembly process of the switch unit 30, the pair of contact plates 34 are opposed to one another through the spacer plate 33 in such a manner that the conductive materials 34*a* are located inside of the contact plates 34, and the rigid plate 32 is overlapped with the upper contact plate 34. Thus, the component parts of the switch unit 30 are inserted into the elastic tubular cover 31 as shown in FIG. 5, and the elastic tubular cover 31 is adhered or welded at opposite ends thereof as shown in FIG. 4. In this instance, the lead wire 35 is extended outwardly from one end of the tubular cover 31. The switch unit 30 is positioned between the positioning projections 23 and 24 in such a manner that the ridges 31*b* of tubular cover 31 are opposed to the upper surface of actuator plate 21. Thereafter, the cover plate 25 is coupled over the switch unit 30 and fixed to the casing 11 by means of the fastening bolts 26 so that the projections 22 of actuator plate 21 are engaged with the ridges 31*b* of tubular cover 31. Thus, the actuator plate 21 serves to prevent entry of water into the switch unit 30, while the cover plate 25 serves to prevent entry of contaminants into the switch unit 30. When the cover plate 25 is removed, maintenace and inspection of the switch unit 30 can be easily carried out.

In operation of the ice making mechanism 10, ice pieces are delivered from the refrigeration housing 10*a* toward the delivery chute 14 through the bottom portion of ice discharge casing 11 and fall into the ice storage bin (not shown) through the delivery chute 14. When the amount of ice pieces stored in the storage bin is less than a predetermined amount, the ice pieces fall into the storage bin without moving the detection plate 15*c*. When the delivery chute 14 is filled with the ice pieces, the detection plate 15*d* is moved by ice pieces further delivered from the ice discharge casing 11 to operate the detection switch 15*c*. As a result, the geared-motor 10*b* of ice making machine 10 is deactivated under control of an electric control apparatus (not shown) to prevent the ice discharge casing 11 from being blocked with the ice pieces.

In such normal operation of the ice making machine 10 as described above, the actuator plate 21 is maintained in place without being applied with any forces to maintain the switch unit 30 in its open position. If the ice making machine 10 is continuously operated due to damage of the ice detection device 15 after the delivery chute 14 has been filled with the ice pieces, the ice discharge casing 11 is filled with ice pieces supplied from the refrigeration housing 10*a*. In this instance, the actuator plate 21 is raised by the ice pieces applied thereto, and the elastic cover 31 is deformed by upward movement of actuator plate 21 to bring the lower contact plate 34 into contact with the upper contact plate 34 through the openings 33*c* of spacer plate 33 thereby to close the switch unit 30. The upward movement of actuator plate 21 is restricted by engagement with the cover plate 25 at its positioning projections 23 and 24, and the engagement of contact plates 34 is effected by support of the rigid plate 32.

When the switch unit 30 is maintained in its closed position for more than five minutes, the geared-motor 10*b* of ice making mechanism 10 is deactivated under control of the electric control apparatus to prevent further increase of the pressure in the ice discharge casing 11 caused by the ice pieces blocked therein. Since in operation of the spout switch assembly 20 the upward movement of actuator plate 21 is restricted by engagement with the cover plate 25 at its positioning projections 23 and 24, the switch unit 30 is protected from excessive pressure caused by engagement with the projections 22. Since the switch unit 30 is closed by small pressure partially caused by upward movement of the projections 22, the ice pieces filled in the discharge casing 11 can be detected to avoid the occurrence of secondary trouble caused by excessive increase of the internal pressure of casing 11.

In case the ice making performance excessively increases due to fall of the ambient temperature or the water temperature or ice pieces are packed in the refrigeration housing 10*a*, the ice discharge casing 11 is supplied at a time with a large amount of ice pieces from the refrigeration housing 10. In this instance, the ice pieces are crumbled by abutment against the upper wall of casing 11 located above the refrigeration housing 10*a* and discharged through the discharge passage 11 to fall into the ice storage bin through the delivery chute 14. Accordingly, the ice discharge casing 11 is not filled with the ice pieces, and the ice making mechanism 10 is continuously operated.

Since the contact plates 34 are sealed within the elastic tubular cover 31, the switch unit 30 is reliably operated without any influence caused by melted water of the ice pieces.

What is claimed is:

1. A protective device for an auger type ice making machine having an auger type ice making mechanism the refrigeration housing of which is located adjacent an ice storage bin and provided thereon with an ice discharge casing forming a lateral discharge passage for discharging ice pieces into the storage bin through an upright delivery chute, comprising:

ice detection means disposed at an upper portion of the upright delivery chute, said ice detection means for detecting a level of ice in the delivery chute; and a spout switch assembly mounted on an upper wall of said ice discharge casing at a position laterally displaced from an upper end of said refrigeration housing to detect ice pieces filled in said ice discharge casing during operation of said ice making mechanism.

2. A protective device for an auger type ice making machine as claimed in claim 1, wherein the upper wall of said ice discharge casing is formed with an opening at the position laterally displaced from the upper end of said refrigeration housing, and wherein said spout switch assembly comprises an actuator plate coupled with the upper opening of said ice discharge casing to be movable in a vertical direction and exposed to the interior of said discharge casing, a cover plate detachably coupled over the upper opening of said discharge casing and fixed in place on the upper wall of said discharge casing, and a switch unit disposed between said actuator plate and said cover plate to be operated by upward movement of said actuator plate.

3. A protective device for an auger type ice making machine as claimed in claim 2, wherein said switch unit comprises an elastic tubular cover disposed within a space between said actuator plate and said cover plate and a pair of contact plates opposed to one another through a spacer plate and contained within said tubular cover, said contact plates each being made of elastic insulation material and coated with a conductive material at their inside surfaces, and said spacer plate being made of insulation material and formed with a plurality of openings through which said contact plates are brought into contact to one another.

4. A protective device for an auger type ice making machine as claimed in claim 3, wherein said actuator plate is formed with a plurality of projections for engagement with a bottom portion of said tubular cover and a plurality of positioning projections for engagement with a peripheral portion of said tubular cover and for engagement with said cover plate.

* * * * *